US005636544A

United States Patent [19]

Tomizawa et al.

[11] Patent Number: 5,636,544

[45] Date of Patent: Jun. 10, 1997

[54] COLD ROLLING METHOD FOR A METAL STRIP AND A MILL ARRAY

[75] Inventors: Atsushi Tomizawa; Hideo Yamamoto; Takeshi Masui, all of Hyogo-ken; Kiyotaka Hori, Ibaraki-ken; Ryuji Hamada, Iaraki-ken; Shunji Kamata; Toru Kaneko, both of Ibaraki-ken; Yutaka Matsuda, Hiroshima-ken; Kazuhiko Horie, Hiroshima-ken; Tsuneo Nakano, Hiroshima-ken; Shoichi Hashimoto, Hiroshima-ken; Hideaki Furumoto, Hiroshima-ken, all of Japan

[73] Assignees: Sumitomo Metal Industries, Ltd., Osaka; Mitsubishi Jukogyo Kabushiki Kaisha, Tokyo, both of Japan

[21] Appl. No.: 347,459

[22] PCT Filed: Nov. 16, 1992

[86] PCT No.: PCT/JP92/01497

§ 371 Date: Jan. 31, 1995

§ 102(e) Date: Jan. 31, 1995

[87] PCT Pub. No.: WO93/24252

PCT Pub. Date: Dec. 9, 1993

[30] Foreign Application Priority Data

Jun. 4, 1992 [JP] Japan ..... 4-168287

[51] Int. Cl.[6] ..... B21B 1/28

[52] U.S. Cl. ..... 72/366.2; 72/234

[58] Field of Search ..... 72/234, 241.2, 72/241.4, 252.5, 365.2, 366.2

[56] References Cited

U.S. PATENT DOCUMENTS

| | | | |
|---|---|---|---|
| 4,385,512 | 5/1983 | Matsumoto et al. | 72/234 |
| 4,453,393 | 6/1984 | Hino et al. | 72/241.8 |
| 4,697,320 | 10/1987 | Ishihara et al. | 492/3 |
| 4,727,741 | 3/1988 | Ushifusa et al. | 72/237 |
| 4,885,042 | 12/1989 | Kenmochi et al. | 72/365.2 |
| 5,291,770 | 3/1994 | Koujin et al. | 72/237 |

FOREIGN PATENT DOCUMENTS

| | | | |
|---|---|---|---|
| 58-61902 | 10/1981 | Japan . | |
| 57-118804 | 7/1982 | Japan . | |
| 58-138505 | 8/1983 | Japan . | |
| 59-183908 | 10/1984 | Japan . | |
| 59-197302 | 11/1984 | Japan . | |
| 60-36321 | 8/1985 | Japan . | |
| 2-107751 | 4/1990 | Japan | 72/252.5 |
| 471701 | 7/1990 | Japan . | |

*Primary Examiner*—Lowell A. Larson
*Assistant Examiner*—Thomas C. Schoeffler
*Attorney, Agent, or Firm*—Burns, Doane, Swecker & Mathis, LLP

[57] ABSTRACT

A rolled metal strip which is free of torsion and on which a superior gloss is obtained by a combination of cross rolling and parallel rolling upon cold rolling a metal strip and by rolling the material in a parallel rolling manner in either at least the final stand (in the case of a tandem mill array) or at least the final pass (in the case of a single stand mill such as a reversible mill or the like). If necessary, the metal strip is preliminarily rolled by cross rolling at a rolling reduction rate of over 5% and then cold rolled by either parallel rolling or a combination of cross rolling and parallel rolling.

10 Claims, 8 Drawing Sheets

$$\text{TORSION RATE } \xi = \frac{H}{L \times W} \ (\mathrm{mm}^{-1})$$

COLD ROLLING METHOD FOR A METAL STRIP AND A MILL ARRAY

TECHNICAL FIELD

This invention relates to a cold rolling method for a metal strip such as a steel strip, a stainless steel strip, and the like and a mill array and in particular to a cold rolling method in which cross rolling prevents torsion in the material, thereby producing a metal strip having excellent surface gloss, and a mill array to be used in the method.

BACKGROUND ART

Recently, increasing demands have been made with respect to the shape and thickness of rolled metal strips (hereinafter referred to as "rolled strip"). Consequently, in order to control a crown of the rolled strip, several methods have been adopted in which a metal strip (hereinafter referred to as "strip") is rolled by upper and lower work rolls which cross in a plane parallel to the strip (hereinafter referred to as "work cross rolling") or is rolled by a pair of work roll and backup roll which cross in the plane (hereinafter referred to as "pair-cross rolling"). These cross rolling methods have already been widely introduced in hot rolling since they exhibit excellent control ability. However, if they are applied to cold rolling which requires high dimensional accuracy, it is necessary to prevent the rolled strip from twisting. In order to respond to demands relating to a wide variety of strip, thicknesses, and widths, a cold rolling mill with a high level of control is required. Although the cross rolling method is excellent with respect to its control ability, it has not been satisfactorily used in cold rolling due to the problem of torsion.

The reason why torsion is caused in the rolled strip by the cross rolling will be explained below by referring to FIG. 4. FIG. 4(*a*) is an explanatory view illustrating a torsion in the rolled strip 4 when the strip 3 is rolled by a pair of upper and lower rolls 1 and 2 which are crossed in a plane parallel to the strip 3. The rolled strip 4 is pushed down at an edge side A and pushed up at an edge side B during rolling by virtue of the position of the work rolls 1 and 2. This causes torsion in the rolled strip 4.

FIG. 4(*b*) is an explanatory view illustrating a torsion in the rolled strip 4 when the strip 3 is rolled by cross rolling method. As shown in FIG. 4(*b*), the rolled strip 4 is subjected to a shearing force $F_1$ in the strip width direction on the top side and to a shearing force $F_2$ in the strip width direction on the bottom side due to the fact that rotary axes of the work rolls 1 and 2 are not perpendicular to a rolling direction X. This causes torsion in the rolled strip 4. These torsions occur in opposing directions to each other, but do not cancel each other out since the torsion caused by shearing forces is larger than the torsion caused by the geometry of the work rolls in cold rolling. Consequently, torsion remains; in the rolled strip 4.

In hot rolling, recrystallization takes place in the rolled strip immediately after rolling even if a shearing force which causes torsion acts on the rolled strip. Accordingly, if tension is applied to the rolled strip except at the top and bottom ends thereof and the rolled strip is formed to be virtually flat, residual stress which would cause torsion is disappear. Consequently, there is substantially no problem of torsion.

In cold rolling, there is no stress relief caused by the recrystallization immediately after rolling, and therefore torsion is caused in the rolled strip. In particular, in the case of products without annealing, there is a serious problem with respect to quality, if torsion remains in the rolled strip.

Also, the rolled material exhibiting torsion caused a deterioration in strip-passing operations in a process line such as in a continuous annealing line and the like.

Japanese Patent Publication No. 59-41804 (1984) discloses a rolling line in which intersection angles of the upper and lower work rolls are set to be reversed alternately in the order of mills in a rolling line in which cross mills are arranged in tandem. Also, Japanese Patent Public Disclosure No. 59-144503 (1984) discloses a rolling line which has mills with one of a pair of work rolls being arranged in a direction perpendicular to the rolling direction and the other of the rolls being arranged in a direction crossing with the one in a plane parallel to the one of rolls and reverses the arrangement of the work rolls in each mill.

However, even if cold rolling is carried out in these rolling lines, the directions of torsion in the rolled strip are reversed at each rolling stand and torsion remains in the rolled strip after the final pass. Accordingly, the problem of torsion in the rolled strip is not removed.

There is a problem of producing torsion in the rolled strip, as described above, in cross rolling for controlling a strip crown. On the other hand, there are increasing demands for high accuracy of thickness and shape of rolled strips. In the rolling methods disclosed in JPP Nos. 59-41804 and 59-144503, torsion still remains in the rolled strip after a final pass.

On the other hand, in order to produce a metal strip, for example, a cold rolled stainless steel strip, a hot rolled stainless steel strip which is either pickled or annealed and pickled is cold rolled during supply of a lubrication oil thereto, is either annealed and pickled or bright annealed, and the finished by skinpass rolling.

A cold rolled stainless steel strip is required, in particular, to have excellent surface gloss, since it is generally used as a product as finished skinpass rolled. As a method for improving the surface gloss of a cold rolled stainless steel strip, for example, Japanese Patent Public Disclosure No. 2-169108 (1990) discloses a method which anneals and pickles a hot rolled stainless steel strip and then cold rolls the strip at a rolling reduction rate of over 5% by employing work rolls having crossed grooves provided on the surface. This method is intended to flow a lubricant oil existing between the work rolls and the steel strip out of a roll bite by cold rolling the strip by means of work rolls having such crossed grooves provided on the outer surface. If a quantity of the lubricant oil exists in recesses on the surface of the strip between the work rolls and the strip, there is nowhere for the lubrication oil to escape to when the strip contacts with the work rolls in the roll bite. Thus trapped lubrication oil causes surface roughness on the strip prior to being cold rolled leave on the strip after being cold rolled, even if the recesses on the strip after being rolled are made smaller than those prior to being cold rolled.

However, there are the following problems in the method disclosed in JPPD No. 2-189108:

a. it is troublesome to Form cross grooves on the roll;

b. in the case that the grooves are shallow and few, convex-shape defects are formed on the surface of the rolled material and a high pressure acts on the raised portions during subsequent cold rolling, thereby resulting in seizure due to a lack of lubrication; and c. the crossed grooves are loaded or worn during rolling, thereby reducing an oil lubrication effect.

Amount of the cold rolled stainless steel strip as finished skinpass rolled increase and in particular the excellent surface gloss of the strip has been required. In order to improve the surface gloss of a cold rolled stainless steel strip, it is necessary to reduce a surface roughness of the strip. It is known to reduce a surface roughness of a hot rolled strip before cold rolling or to reduce the surface roughness of the strip during initial passes in cold rolling.

However, it is difficult to realize the method disclosed in JPPD No. 2-169108 and it is also difficult to provide a sufficient surface gloss.

The inventors have discovered that a metal strip surface having a high gloss can be obtained by providing the strip with a sliding force in a strip width direction between the surface of the strip and work rolls so that a surface layer of the metal is deformed by shearing in the strip width direction. The strip is then brought into contact with the work rolls in order to bring about an improvement in its surface gloss. In particular, cross rolling is effective as a method of providing a strip with a sliding force in the strip width direction between the surface of the metal strip and the work rolls.

If the cross rolling mill is applied to all stands in a tandem mill line, however, torsion occurs in rolled strip. These products sometimes are rejected because of the torsion.

An object of the present invention is to provide a method and a mill array of producing a metal strip having no torsion occurring in a rolled strip by means of a relatively simple process upon cold rolling in a cross rolling manner and an excellent surface gloss.

Still another object is to eliminate torsion in a rolled metal strip and to carry out cross type tandem rolling without any deterioration in surface gloss.

DISCLOSURE OF INVENTION

A basic cold rolling method for a metal strip in accordance with the present invention is characterized, in a cold rolling method for a metal strip wherein cross rolling processes are first carried out and parallel rolling processes are second carried out upon cold rolling the metal strip, by setting a surface roughness of work rolls in at least the cross rolling processes to be 0.1 to 2 μm in an average roughness Ra; and setting a total rolling reduction rate in the parallel rolling processes to be over 3%.

In a step of cross rolling the rolled metal strip by a cross rolling mill array provided with at least one of work roll mills a work roll of which is 0.1 to 2 μm in an average roughness Ra, a sliding force is applied to the strip in the strip width direction by the crossed upper and lower work rolls. The sliding force deforms the surface layer in the rolled metal strip by shearing, thereby imparting to the surface of the strip a high gloss and suppressing the torsion rate to be a lower level.

In the next parallel rolling step, the metal strip which passes the parallel rolling mill is parallel-rolled at the total reduction rate of more than 3%, thereby correcting the torsion caused in the former stand and enabling to roll the metal strip having a high gloss and no torsion.

Said cross rolling process comprising a rolling stage by a plurality of cross rolls and crossing directions of upper and lower work rolls in the rolling stage are alternately reversed.

Preferably, a total rolling reduction rate in said parallel rolling process is less than 8%.

Preferably, said metal strip is prepared for preliminary cold rolling by cross rolling at a rolling reduction rate of over 5% a pickled hot rolled strip.

Preferably, said metal strip is prepared for preliminary rolling by cross rolling at a rolling reduction rate of over 5% a hot rolled strip which is pickled after annealing.

Preferably, said metal strip is prepared for preliminary rolling by cross rolling at a rolling reduction rate of over 5% a cold rolled strip which is either intermediately annealed after cold rolling or intermediately annealed and intermediately pickled.

Preferably, said metal strip is a stainless steel.

Preferably, a cross angle α of the work rolls in said preliminary rolling is over 0.2 degs.

A tandem mill array to which the method of the present invention is applied may be any type one. The present invention can be carried out in all mills which can effect rolling by a manner of cross rolling.

In particular, as a preferable mill array for embodying the present invention, in a cross type tandem mill array wherein mills for cold rolling a metal strip by a pair of upper and lower work rolls are arrayed in tandem, the array is characterized by providing at an upper stream a cold rolling mill with a plurality of stands, which rolls the metal strip by crossing the axes of the upper and lower work rolls in the plane parallel to the surface of the metal strip, a crossing direction of said work rolls in each stand being alternately reversed; and providing at a lower stream at least a parallel rolling mill.

The tandem mill array or the reversible rolling mill to which the method of the present invention is applied may be any type of multihigh mill such as a three-high mill, a four-high mill, a five-high mill, a six-high mill, or a sendzimir mill as well as a two-high mill and can include all mills which can roll a material in a cross rolling manner.

BEST MODE FOR CARRYING OUT THE INVENTION

In the present invention, "cross rolling" is defined by rolling a metal strip 3 to be rolled (hereinafter referred to as "a strip") by a pair of upper and lower work rolls with the upper and lower roll axes being crossed at an angle (α) in opposite directions with respect to a direction perpendicular to the rolling direction (longitudinal direction) in a plane parallel to the rolling plane. In the multihigh mill (four-high mill, six-high mill, or the like), either work rolls or work rolls and backup rolls may be crossed. "parallel rolling" is defined by usual rolling a material by upper and lower work rolls with the upper and lower roll axes being set in perpendicular to the rolling direction (longitudinal direction).

Figure 5:
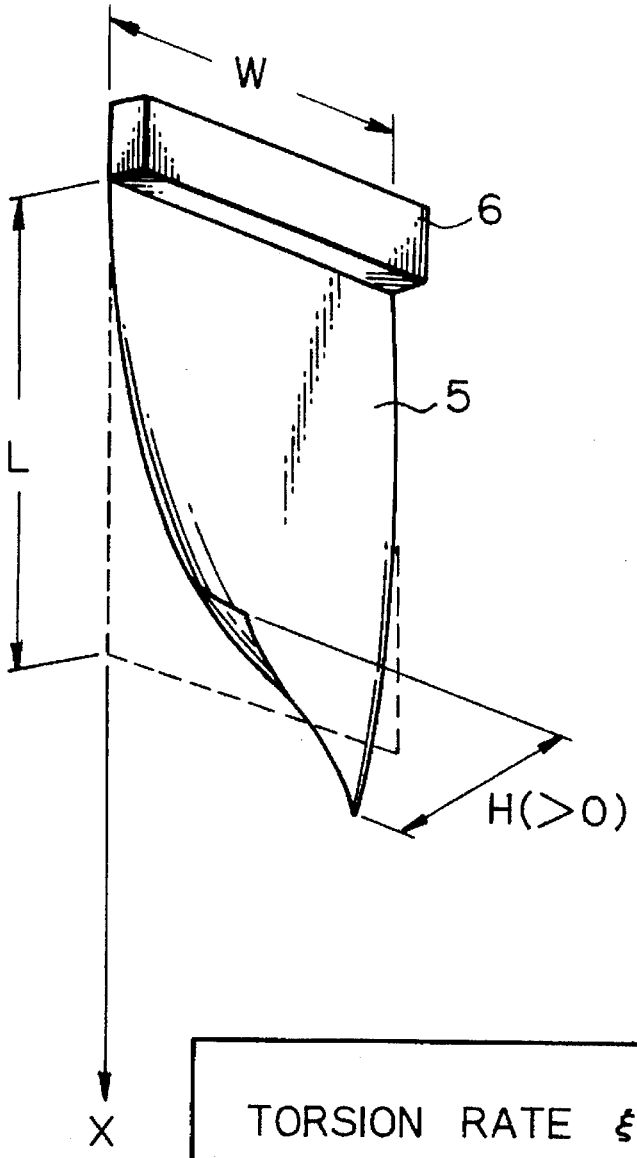
FIG. 5 is an explanatory view of a method for calculating a torsion rate of a rolled metal strip.

Referring now to FIG. 5, a method for measuring a torsion in a rolled strip is explained. A torsion rate ξ in a rolled material is determined in the following manner. First, each test piece 5 is made by cutting into a given length the rolled material at each stand. Second, the test piece 5 is secured to a fixing 6 at one end thereof by the method shown in FIG. 5 and then a torsion distance H at the other end of the test piece 5 is measured. Third, the torsion rate ξ in the rolled material is calculated by dividing the distance H by "length L×width W". The torsion rate ξ is defined by the equation: $\xi=H/(L\times W)$. The positive and negative signs of the torsion rate ξ in the rolled material are defined below. The torsion rate ξ is positive if the lower left end of the rolled material is twisted toward the right in a vertical plane parallel to the rolling direction X in FIG. 5. Contrarily, the torsion rate ξ is negative if the lower left end is twisted toward the left. In FIG. 5, the distance H is positive, that is, the rate ξ is positive.

Figure 6:
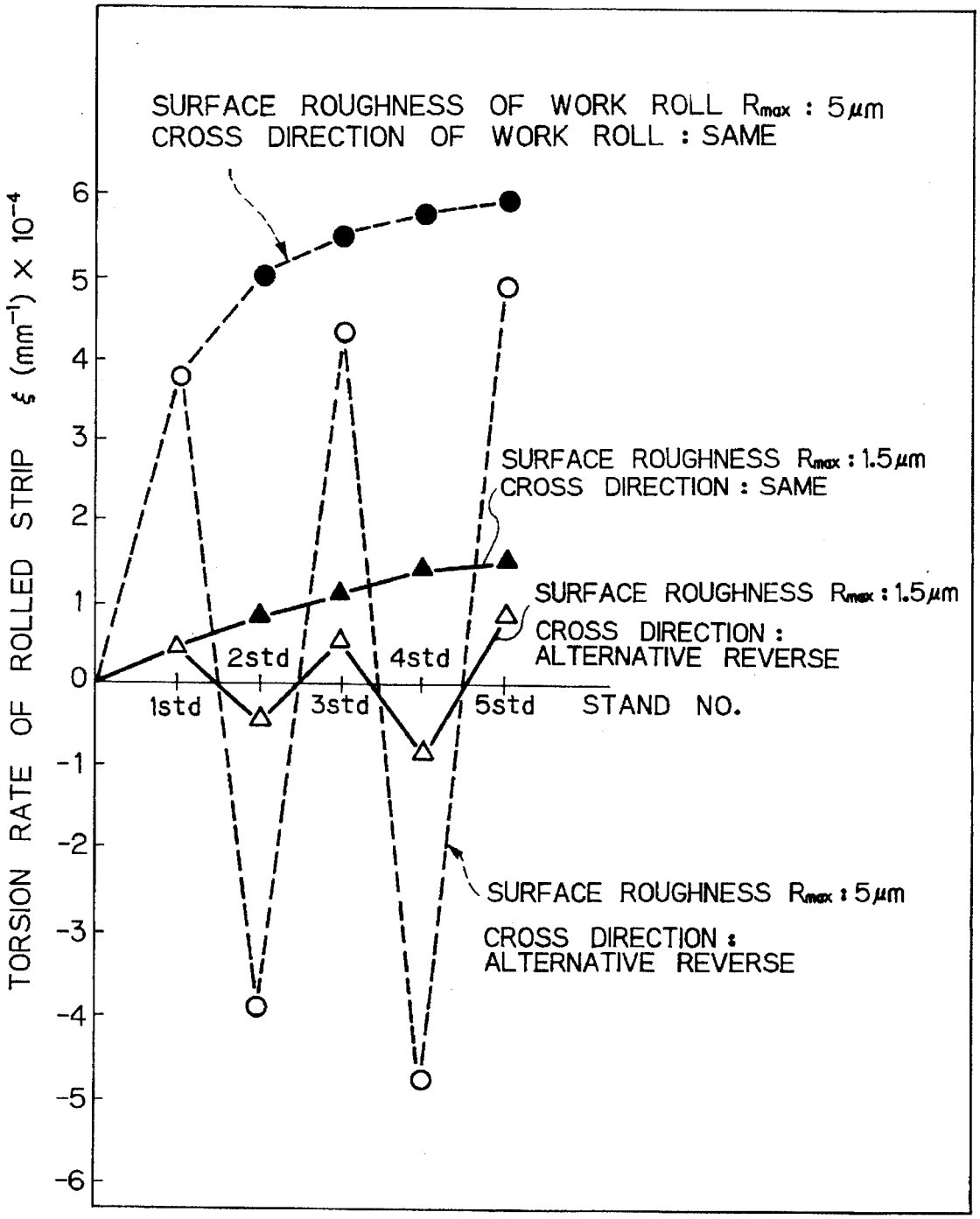
FIG. 6 is a diagram showing a torsion rate of a rolled strip at each stand.

FIG. 6 shows a torsion rate ξ of the rolled strip at each stand. When a strip made of a high tension steel (T.S.:100 kgf/mm$^2$) is rolled from 8.2 mm to 1.2 mm in thickness at a constant cross angle (0.75°) of the work roll in the tandem mill array having five stands which have work rolls of 500 mm in diameter in pair-cross rolling mill, the torsion rate ξ of the rolled strip is measured at each stand. The rolling reduction rate at each stand was 20%, 20%, 20%, 15%, and 15%.

FIG. 6 shows the respective torsion rates of the rolled strip in the case of rolling the material at the same cross angles of the work rolls of all stands (marks ● and ▲ in the drawing) and in the case of rolling the material by alternately reversing the intersection angle (marks ○ and Δ in the drawing), under two levels of the surface roughnesses Rmax of 5 μm (marks ○ and ● in the drawing) and of 1.5 μm (marks Δ and Δ in the drawing) on the work rolls of all stands.

The following respects will be understood from FIG. 6. First, if the intersection direction of the upper and lower work rolls of all stands is the same and the cross angle is constant, upon rolling, the torsion rate of the rolled material increases at each stand. Second, if the intersection direction and angle of the upper and lower work rolls are the same, respectively, and the surface roughness of the work rolls is low, upon rolling, the torsion rate of the rolled material becomes low. Third, if the intersection direction of the upper and lower work rolls is alternately reversed while keeping the cross angle constant, the torsion rate of the rolled material alternately changes the plus and minus signs at each stand and the absolute value of the torsion rate becomes smaller than that upon rolling at the same cross angle of the upper and lower work rolls. However, the absolute value increases as the material is rolled at the downstream stands.

Figure 7:
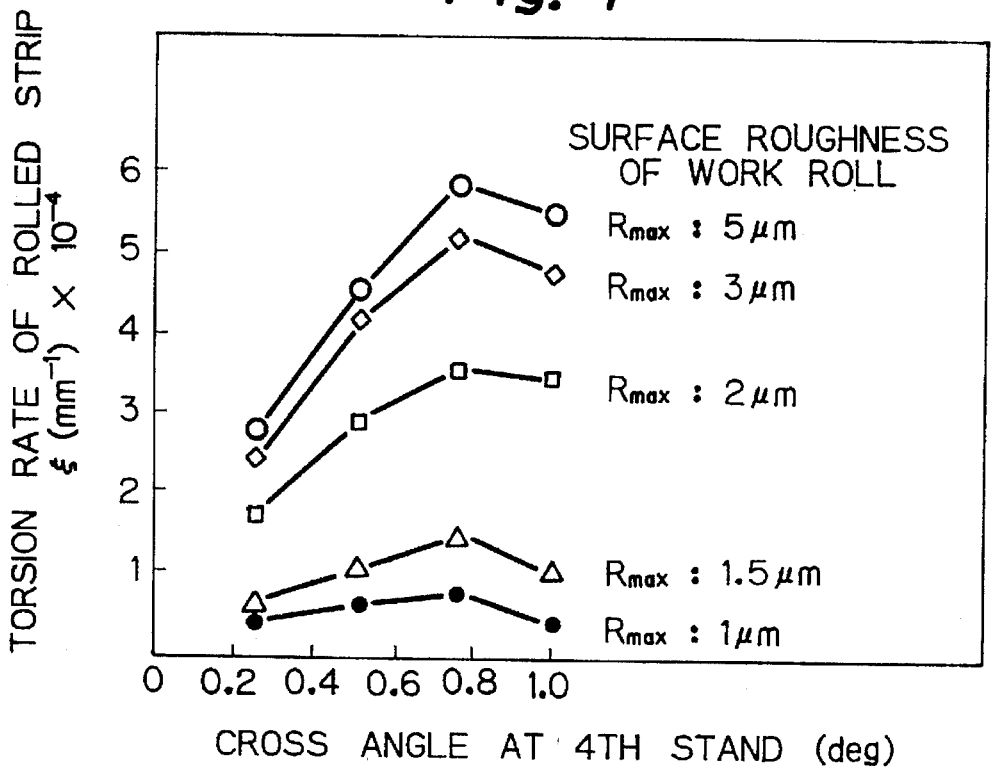
FIG. 7 is a diagram showing a relationship between cross angles of upper and lower work rolls at the final stand and torsion rates of a rolled strip after the final stand.

FIG. 7 shows a relationship between the cross angle of the upper and lower work rolls at the fourth stand and the torsion rate of the rolled material after passing through the fourth stand. The torsion rate of the rolled material after passing through the fourth stand is measured under the following condition. A plate material made of a high tension steel (T.S.:100 kgf/mm$^2$) is rolled from 3.2 mm to 1.2 mm in thickness at the constant cross angle (0.75°) and direction of the upper and lower work rolls at the 1st to 3rd stands in the tandem mill array and at the variable cross angle (0.25 to 1.0°) and the constant intersection direction at the 4th stand. The rolling reduction at the 4th stand was 15%.

FIG. 7 shows the torsion rates of the rolled strip under five levels of surface roughnesses Rmax of 5 μm (mark ○ in the drawing), 3 μm (mark ◇ in the drawing), 2 μm (mark □ in the drawing), 1.5 μm (mark Δ in the drawing) and 1 μm (mark ● in the drawing) on the work rolls of the 1st to 4th stands.

The following respects will be understood from FIG. 7. The torsion rate of the rolled material decreases as the cross angle of the upper and lower work rolls at the 4th stand becomes smaller if the surface roughness of the work rolls is constant, the torsion rate of the rolled material becomes maximum when the cross angle is 0.75° and the torsion rate of the rolled material decreases again when the cross angle is over 0.75°.

Figure 8:
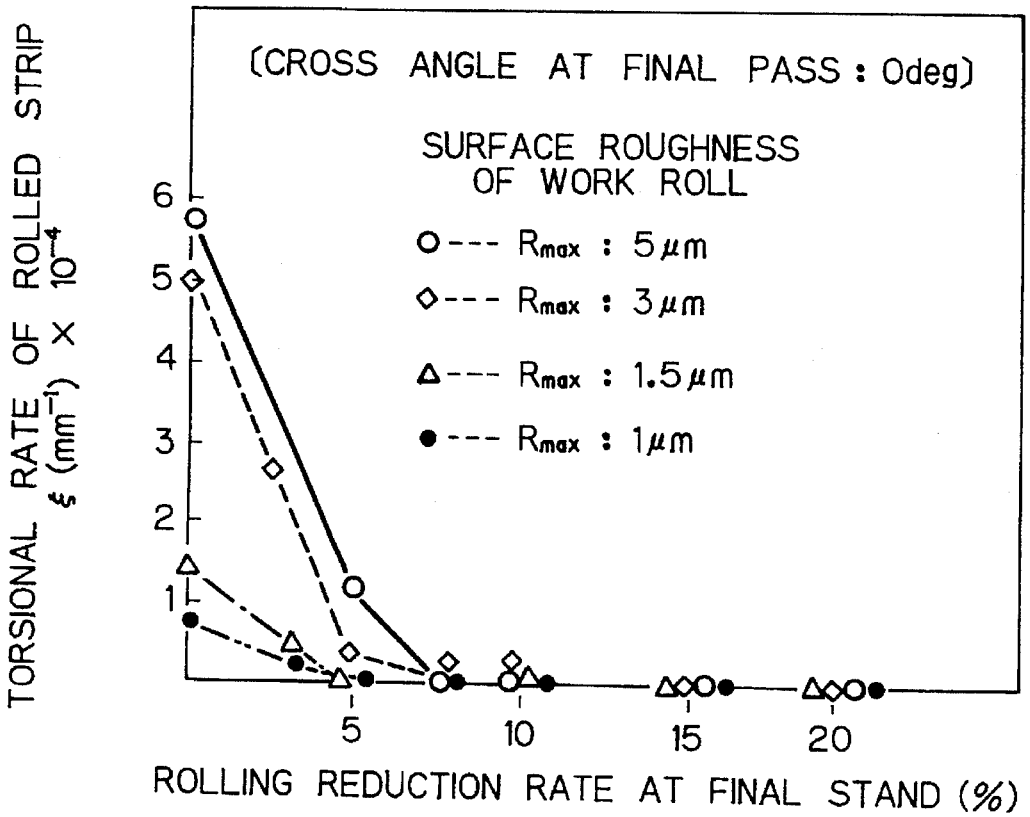
FIG. 8 is a diagram showing a relationship between rolling reduction rates at the final stand and torsion rates of a rolled strip after the final stand.

FIG. 8 shows a relationship between the rolling reduction rate at the final stand and the torsion rate of the rolled strip after the final stand. The torsion rate of the rolled strip in FIG. 8 is obtained under the condition in which a strip made of a high tension steel (T.S.:100 kgf/mm$^2$) is rolled from 3.2 mm to 1.3 mm in thickness while keeping the cross angle (0.75° at the maximum torsion rate of the rolled material), the intersection direction, and the rolling reduction rate (20%) constant to the upper and lower work rolls at the 1st to 4th stands in the tandem mill array and then rolled at the variable rolling reduction rates of 0 to 20% without crossing the upper and lower work rolls at the 5th (final) stand.

The torsion rates of the rolled material in FIG. 8 are shown under four levels of the surface roughnesses Rmax of 5 μm (mark ○ in the drawing), 3 μm (mark ◇ in the drawing), 1.5 μm (mark Δ in the drawing) and 1 μm (mark ● in the drawing) on the work rolls at the 1st to 5th stands.

The following respects will be understood from FIG. 8. The torsion rate of the rolled material is greatly reduced as the rolling reduction rate at the final stand becomes larger, unless the upper and lower work rolls at the final stand are crossed in spite of the values of the torsion rate up to the fourth stand. When the rolling reduction rate is over 5%, a problem in torsion of the rolled material is little as products. Also, when the rolling reduction rate is over 10%, the torsion will not occur in the rolled material.

It is described in the foregoing that the torsion in the rolled material can be reduced by rolling the material by the work roll parallel rolling at only the final stand in the tandem mill array.

However, it will be apparent from the above description that the parallel rolling may be started from an intermediate stand, not always from the final stand, in order to eliminate the torsion of the rolled material. In addition, the experience obtained by using the tandem mill array can be likewise applied to the reversible rolling mill which can carry out the cross rolling.

In summary, it is possible to extremely reduce the torsion of the rolled material by rolling the material by the parallel manner in at least the final stand (in the case of the tandem mill array) or the final pass (in the case of the reversible rolling mill) upon rolling by the cross rolling manner. Further, it is possible to obtain a rolled material with a torsion free by setting the rolling reduction rate in the parallel rolling to be an adequately high in accordance with the torsion rate of the rolled material in the cross rolling.

As mentioned above, even if only the cross angle of the upper and lower work rolls is alternately reversed at each stand (pass) to effect rolling, it can not be a fundamental solution, since the torsion rate of the rolled material is increased at the downstream stands (passes). However, it is most effective to employ the rolling method which reverses the cross angle of the upper and lower work rolls alternately at each stand (pass) and to dispose at least the parallel rolling mill at the downstream in order to reduce the torsion in addition to the rolling method of the present invention, since the absolute value of the torsion rate of the rolled material is decreased more than the rolling while maintaining the same cross angle of the upper and lower work rolls.

Next, a cold rolling method for producing a metal strip having an excellent surface gloss in accordance with the present invention will be explained below.

Here, a preliminary cold rolling by the cross rolling is carried out as an embodiment suitable for gloss rolling of stainless steel or the like.

Figure 1:
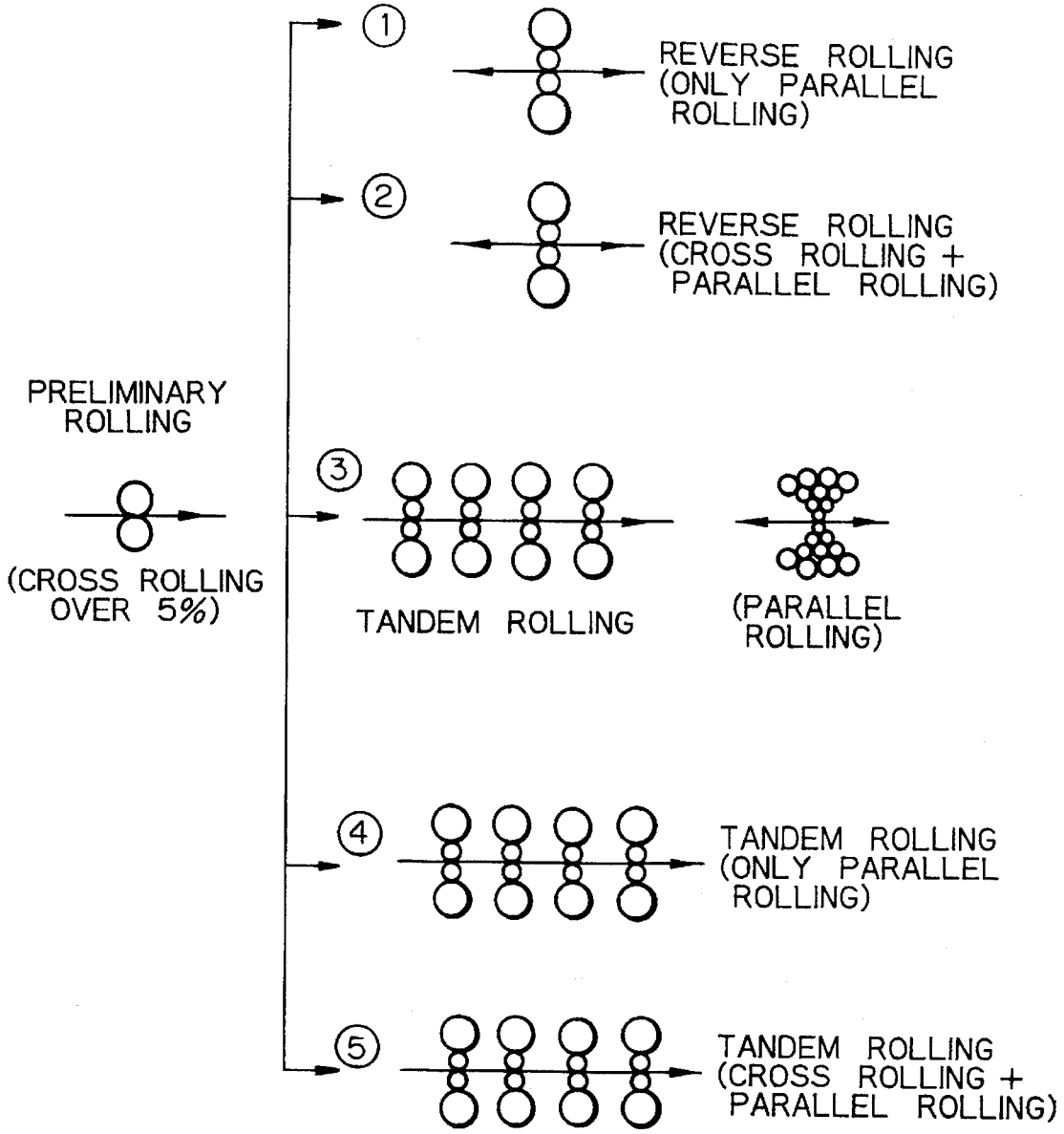
FIG. 1 is a schematic view of a rolling line illustrating embodiments using a preliminary rolling mill in accordance with the present invention.
Figure 2:
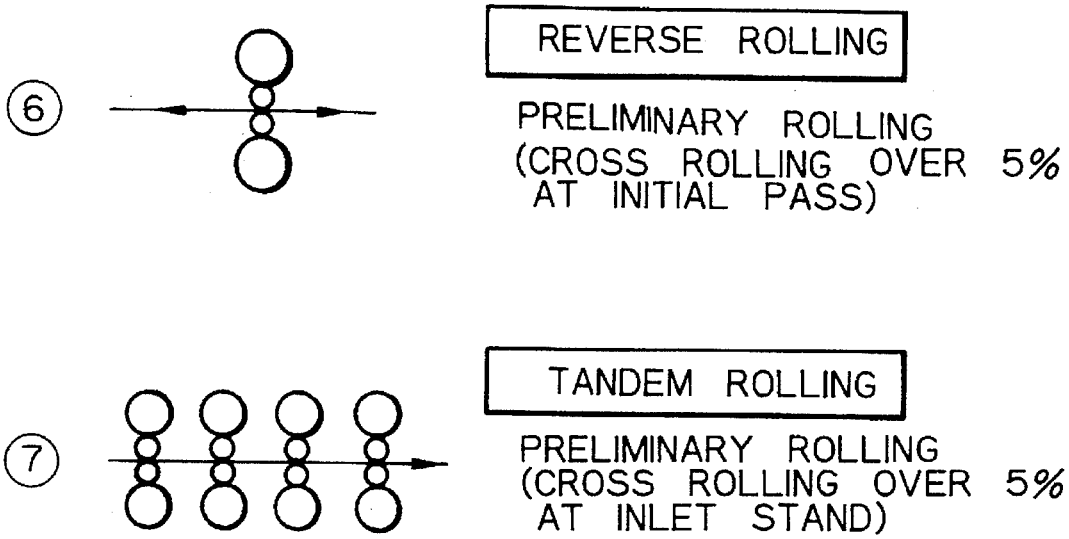
FIG. 2 is a schematic view of a rolling line illustrating embodiments using no preliminary rolling mill in accordance with the present invention.

FIGS. 1 and 2 show a typical embodiment of the method of the present invention.

The method of the present invention can be classified into a case where a special preliminary rolling mill is used and a case where the mill is not used and a usual (existing) mill is used. A metal strip is pickled to remove oxide from the surface, annealed after hot rolling and pickled again to remove remaining oxide from the surface, intermediately annealed after cold rolling, or intermediately annealed and pickled after cold rolling.

I In the case of using a particular preliminary rolling mill (FIG. 1)

A mill for preliminary cold rolling may be of any type which can effect cross rolling. For example, it may be a two, four, or six high mill with one stand.

After cross rolling at a rolling reduction over 5% by a preliminary rolling mill, reversible rolling by a mill with one stand ① or ② (it may be a mill with work rolls having a small diameter such as a sendzimir mill) or tandem rolling by a tandem mill array (a mill with multi-stands) ④ or ⑤ is carried out. ① shows a case in which the reversible rolling is carried out by all parallel rolling manners and ② a case in which the reversible rolling is carried out by the parallel rolling after cross rolling in at least one pass of initial passes.

④ and ⑤ are methods in which a tandem mill array with a plurality of roll stands continuously effects rolling. ④ shows a case in which all tandem rollings (rolling at all stands) is carried out by a parallel rolling manner and ⑤ a case in which tandem rolling is carried out by the parallel rolling after rolling by the cross rolling manner in at least one stand of inlet stands.

If the cross rolling is carried out initially in postrolling (regular rolling) as well as preliminary rolling, as shown in ② and ⑤, surface gloss on a metal strip product can be improved as described below.

③ shows a case in which additional parallel rolling pass or passes are carried out by, for example, the sendzimir mill. In this tandem rolling, there are two cases in which all stands effect parallel rolling and in which at least one of the inlet stands effects cross rolling. The latter is preferable.

II In the case of using no particular preliminary rolling mill (FIG. 2)

This case is a method for effecting initial rolling by a usual mill in the form of preliminary rolling. This can be carried out in either reversible rolling by a mill with one stand or continuous rolling by a tandem mill array.

⑥ shows reversible rolling. In this case, it is necessary to carry out cross rolling at one to several passes in initial passes. This cross rolling at a rolling reduction rate of over 5% corresponds to the above preliminary rolling. Then, parallel rolling provides a finished metal strip.

⑦ shows tandem rolling. In this case, preliminary rolling by a cross rolling manner is effected at one to several stands in inlet stands. Of course, it is necessary to set a rolling reduction rate to be over 5% in cross rolling. Then, parallel rolling at continuous stands finishes a metal strip. Although it is not shown in FIG. 2, rolling by the sendzimir mill may be effected after rolling of ⑥ or ⑦ shown in FIG. 2.

The feature of the present invention resides in that a pickled strip, preferably an annealed and pickled strip is preliminary rolled by a cross rolling manner at a rolling reduction over 5% and then cold rolled in a usual parallel rolling manner.

Figure 3:
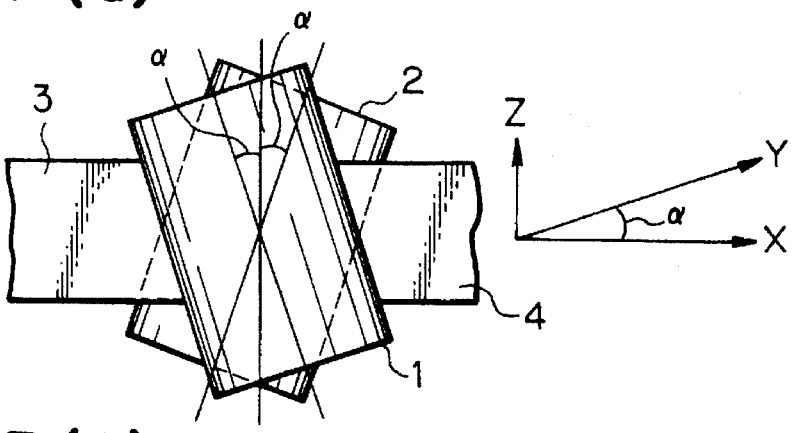
FIG. 3 is an explanatory view of a principle of cross rolling, (a) being a plane view and (b) being a side view.
Figure 3:
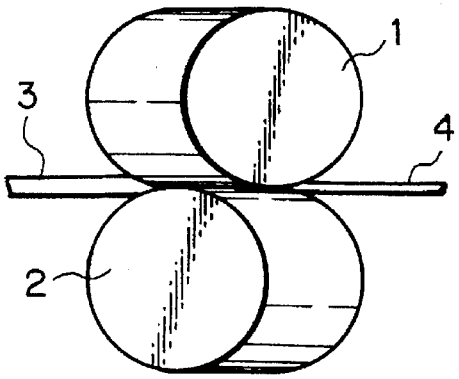
Figure 4:
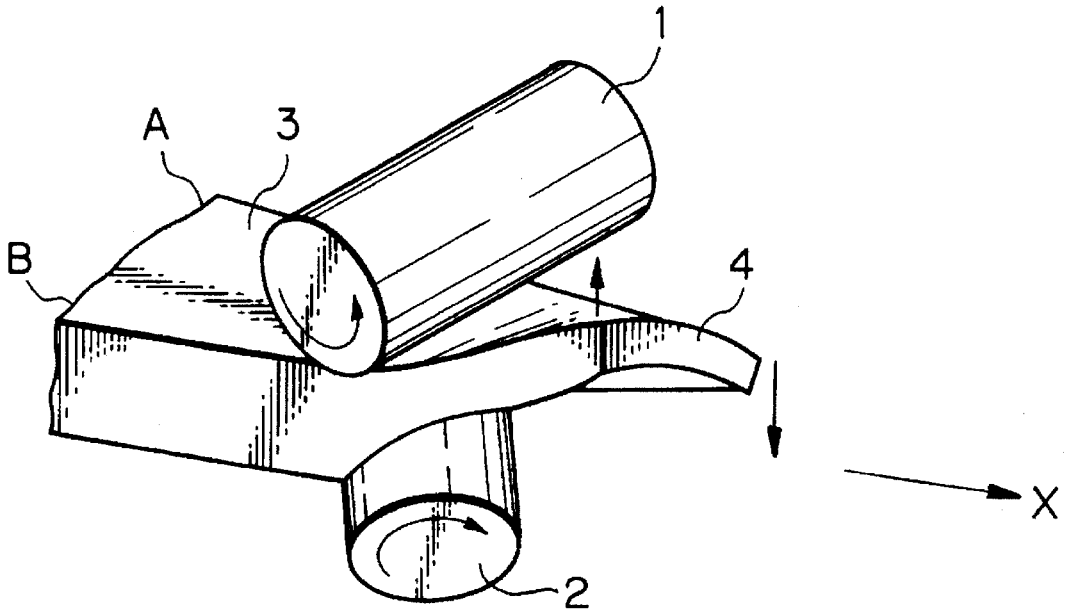
FIG. 4 is a perspective view of a rolled strip, (a) and (b) illustrating the rolled strips which are twisted due to a geometrical arrangement of work rolls upon cross rolling and due to a shearing force created by the work rolls upon cross rolling.
Figure 4:
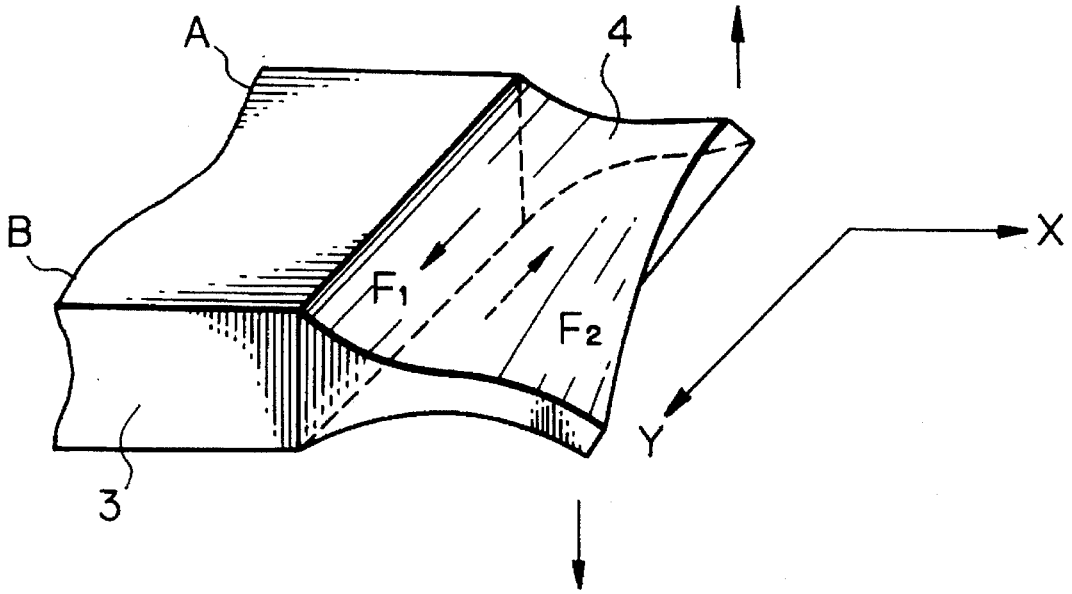

FIG. 3 shows cross rolling in preliminary rolling, namely rolling with upper and lower work rolls being crossed at a cross angle $\alpha$ in a plane parallel to a coiling plane. (a) is a plane view and (b) a side view. In FIG. 3, a material to be rolled is shown as a hot rolled metal strip 3 and a rolled strip is shown as a rolled strip 4.

On the top side of the strip, a cross angle between a passing direction (direction X) of the strip 3 and a rotary circumferential speed direction (direction Y) of an upper work roll 1 which contact with the top side of the strip 3 corresponds to the cross angle $\alpha$. Accordingly, a component of sliding force is caused in a strip width direction (direction Z) on the top side of the strip 3 by the upper work roll 1, thereby causing shearing deformation in the strip 3 at a surface layer portion thereof. Further, protrusions of grinding scratches on the surface of the roll are displaced in the strip width direction and metal contact between the roll and the strip increases. This action uniformly smoothes the top side of the, strip, thereby decreasing surface roughness of the rolled material and thus producing a rolled strip 4 which is superior in smoothness and gloss. This phenomenon takes place between the bottom side of the strip 3 and the lower work roll 2 in the same manner.

In order to obtain a rolled strip superior to gloss, it is preferable to set the cross angle $\alpha$ to be over 0.2°. The greater the cross angle $\alpha$ becomes, the greater the gloss, but shape defects such as a center buckle occurs. In the case of increasing the cross angle $\alpha$, which causes a middle elongation in shape, it is preferable to use work rolls having a concave crown shape (the diameter on the opposite ends of the roll is larger than that on the middle portion of the roll.)

The reason why the rolling reduction rate is set at over 5% under preliminary cold rolling in a cross rolling manner will be described below.

When the rolling reduction rate is less than 5%, the component of sliding force in the strip width direction which is caused on the surface layer in the strip by the work roll becomes small and the shearing deformation in the strip width caused on the surface layer also becomes small. Additionally, in the case of light rolling at a rolling reduction rate of under 5%, an amount of lubricating oil to be introduced into a roll bite is increased and a rate of metal contact between the strip and the work roll decreases. Consequently, the surface roughness of the rolled strip does not decrease and the gloss is not improved. The higher the rolling reduction rate is the better the gloss on the surface of the rolled strip is, but such an effect is saturated when the rolling reduction rate is more than 25%.

The above preliminary rolling may be effected at one pass or several passes so long as a total amount of a rolling reduction rate is more than 5%. It is possible in a usual rolling condition to carry out rolling at 25% or so even at one pass.

There are various methods for preliminary cold rolling of a hot rolled metal strip at a rolling reduction rate of over 5%, as described above. One of them is a method of using the particular mill, as shown in FIG. 1. After the strip is pickled or preferably annealed and pickled, the strip is rolled in a cross rolling mill at a rolling reduction rate of over 5%. Then, the strip is rolled in a usual cold rolling mill (tandem mill array or reversible mill or combination thereof). In the case of providing a particular mill on the outlet side of a pickling line, the strip is preliminarily cold rolled immediately after pickling.

In the case of providing a particular mill independently on an offline mill, after the pickled strip has been wound into a coil, the strip is preliminarily cold rolled before cold rolling. In the case of using a particular mill, extra costs are incurred but a rolling pass schedule in a natural cold rolling mill is not influenced.

Another method of preliminary rolling, as shown in FIG. 2, is to utilize at least the first pass of initial passes (in the reversible mill) or at least one stand of inlet side stands (in the tandem mill array) in the usual cold rolling mill array (reversible mill or tandem mill array). In this case, since a particular mill is not needed, there is no problem of providing new equipment. However, it may be necessary to change a rolling pass schedule in a conventional cold rolling mill.

Usual cold rolling (regular rolling) is carried out after preliminary rolling. This usual cold rolling may be carried out in all parallel rolling manners as shown in ① and ④ in FIG. 1 or by a combination of cross rolling and parallel rolling as shown in ② and ⑤ in FIG. 1. Further, the usual cold rolling may be carried out by a combination of the tandem mill array and a reversible mill such as the sendzimir mill, as shown in ③ in FIG. 1.

When the cold rolling mill is a reversible mill, at least one pass (preferably, the first pass) of initial passes is carried out under cold rolling in a cross rolling manner and then the other passes are effected under cold rolling by the usual parallel rolling manner. When the cold rolling mill is a tandem mill array, at least one stand (preferably, the first stand on the the inlet side) of the inlet side stands effects cold rolling in a cross rolling manner and then the other stands effect cold rolling in a usual parallel rolling manner. The rolling reduction rate in this cross rolling is not limited.

Thus, gloss of the rolled strip is greatly improved by carrying out regular cold rolling together with cold rolling in a cross rolling manner after preliminary rolling at the rolling reduction of over 5% in a cross rolling manner.

Preferably, regular cold rolling in a cross rolling manner after the preliminary cold rolling is carried out at a possible initial pass (in the reversible mill) or stand (in the tandem mill array). Desirably, it is carried out within first three passes (in the reversible mill) or first three stands (in the tandem mill array). Cold rolling in a parallel rolling manner is carried out at the other passes or stands. The cold rolling must be effected in a parallel rolling manner. The cross rolling causes torsion in the steel strip due to a shearing force acting in the strip width direction, finish rolling in a parallel rolling manner corrects the torsion.

It is most effective for an average roughness Ra of work rolls in a cold cross rolling mill in accordance with the present invention to be 0.1 to 2.0 μm. An outer diameter of the work roll is not limited. It may be a small one of less than 150 mm or a large one of more than 450 mm. A lubricant oil to be used should be one used in cold rolling of stainless steel and low carbon steel.

Examples embodying the method of the present invention will be explained below.

[EXAMPLE 1]

A tandem mill array having work rolls with an outer diameter of 460 mm and five stands which can effect pair-cross rolling and a reversible mill having work rolls with an outer diameter of 380 mm and one stand which can effect pair-cross rolling rolled a strip consisting of different kind of steel. The finished thicknesses are shown in Tables 1 and 2. The surface roughness of the work roll is 1.5 μm and 5 μm in Rmax. These are 0.2 μm and 0.7 μm in an average roughness Ra. These are within the scope of the claimed invention. Torsion rates after rolling are shown in Tables 1 and 2.

Test Nos. 1 to 6 are examples of the present invention. In these examples, the parallel rolling (the cross angle of the work rolls was 0 degree) was effected at the final stand and the surface roughness of the work rolls at the 4th to 5th stands was 1.5 μm in Rmax. As a result, the torsion rates of these rolled strip were very low and there was no problem in practical use in spite of a low rolling reduction rate of 5% at the final stand. There were few problems when the rolled material passed through a continuous annealing furnace.

Test Nos. 7 to 12 are examples of the present invention. In these examples, the parallel rolling (the cross angle of the work rolls was 0 degree) was effected at the final stand in the same manner as test Nos. 1 to 6. However, on the contrary to Test Nos. 1 to 6, the surface roughnesses of the upper and lower work rolls at all stands were 5 μm in Rmax and the rolling reduction rate was 10%. As a result, the torsion rates of these rolled strip were very low and there was no problem in practical use. Further, there were few troubles when the rolled material passed through the continuous annealing furnace.

Test Nos. 13 to 16 are examples of the present invention. The parallel rolling (the cross angle of the work rolls was 0 degree) was effected at the final pass in the same manner as Test Nos. 1 to 6. As a result, the torsion rates of these rolled materials were very low and there was no problem with respect to practical use. Further, there were few problems when the rolled material passed through the annealing furnace.

Test Nos. 17 to 32 are examples for comparison. In these examples, the cross rolling was effected at the final stand or pass. Torsions were caused in these rolled materials and the resulting commercial value of the rolled material was very low. In addition, there were four times as many problems as in the examples of the present invention when the rolled material passed through the continuous annealing furnace.

TABLE 1

| Section | Test No. | Type of Rolling | Rolled Material: Kind of Steel | Rolled Material: Thickness (mm) | Cross Angle at Final Std or Final Pass (deg) | Surface Roughness of W.R. Rmax (μm) | Rolling Reduction Rate at Final Std or Final Pass (%) | Torsion Rate of Rolled Material (× $10^{-4}$ $mm^{-1}$) |
|---|---|---|---|---|---|---|---|---|
| Examples of Subject Invention | 1 | Tandem | Low Carbon Steel | 2.5 → 0.35 | | 1–3 Std | | 0.04 |
| | 2 | | | 5.5 → 1.25 | | | | 0.000 |
| | 3 | | High Tension Steel | 2.6 → 0.8 | 0 | 5 | | 0.008 |
| | 4 | | | 3.2 → 0.8 | | 4–5 Std | | 0.013 |
| | 5 | | SUS304 | 2.0 → 0.8 | | 1.5 | 5 | 0.020 |
| | 6 | | | 3.0 → 1.0 | | | | 0.019 |
| | 7 | Tandem | Low Carbon Steel | 2.5 → 0.35 | | | | 0.009 |
| | 8 | | | 5.5 → 1.25 | | | | 0.012 |
| | 9 | | High Tension Steel | 2.6 → 0.8 | 0 | 1–5 Std | | 0.010 |
| | 10 | | | 3.2 → 0.8 | | 5 | 10 | 0.025 |
| | 11 | | SUS304 | 2.0 → 0.8 | | | | 0.024 |
| | 12 | | | 3.0 → 1.0 | | | | 0.035 |
| | 13 | Reverse | SUS304 | 3.2 → 1.5 | | | | 0.013 |
| | 14 | | | 3.2 → 0.8 | | | | 0.022 |
| | 15 | | SUS430 | 3.8 → 1.2 | 0 | 1.5 | 5 | 0.017 |
| | 16 | | | 3.8 → 0.6 | | | | 0.033 |

Note: "W.R." designates a Work Roll and "Std" a Stand in the Table.

TABLE 2

| Section | Test No. | Type of Rolling | Rolled Material: Kind of Steel | Rolled Material: Thickness (mm) | Cross Angle at Final Std or Final Pass (deg) | Surface Roughness of W.R. Rmax (μm) | Rolling Reduction Rate at Final Std or Final Pass (%) | Torsion Rate of Rolled Material (× $10^{-4}$ $mm^{-1}$) |
|---|---|---|---|---|---|---|---|---|
| Examples for Comparison | 17 | Tandem | Low Carbon Steel | 2.5 → 0.35 | | 1–3 Std | | 0.32 |
| | 18 | | | 5.5 → 1.25 | | | | 0.47 |
| | 19 | | High Tension Steel | 2.6 → 0.8 | 0.75 | 5 | | 0.63 |
| | 20 | | | 3.2 → 0.8 | | 4–5 Std | | 0.66 |
| | 21 | | SUS304 | 2.0 → 0.8 | | 1.5 | 5 | 0.84 |
| | 22 | | | 3.0 → 1.0 | | | | 1.03 |
| | 23 | Tandem | Low Carbon | 2.5 → 0.35 | | | | 4.35 |
| | 24 | | | 5.5 → 1.25 | | | | 4.27 |
| | 25 | | High Tension Steel | 2.6 → 0.8 | 0.75 | 1–5 Std | | 5.88 |
| | 26 | | | 3.2 → 0.8 | | 5 | 10 | 6.19 |
| | 27 | | SUS304 | 2.0 → 0.8 | | | | 6.92 |
| | 28 | | | 3.0 → 1.0 | | | | 6.75 |
| | 29 | Reverse | SUS304 | 3.2 → 1.5 | | | | 7.96 |
| | 30 | | | 3.2 → 0.8 | | | | 9.15 |
| | 31 | | SUS430 | 3.8 → 1.2 | 0.75 | 1.5 | 5 | 8.94 |
| | 32 | | | 3.8 → 0.6 | | | | 9.30 |

Note: "W.R." designates a Work Roll and "Std" a Stand in the Table.

[EXAMPLE 2]

A material to be tested was a hot rolled strip (4.5 mm in thickness) made of ferritic stainless steel (JIS SUS 430) and treated by annealing and pickling. Preliminary rolling mills to be used were a four-high mill having work rolls with diameters of 450 mm, 350 mm, and 250 mm and a six-high mill having work rolls with diameters of 120 mm and 80 mm. Both mills have one stand. First, these preliminary mills effected the preliminary cold rolling in a cross rolling manner under various conditions as shown in Tables 3 to 5. Second, cold rolling (regular rolling) in the usual parallel rolling manner was effected by a tandem mill array having five stands each of which include work rolls having an outer diameter of 450 mm and backup rolls having an outer diameter of 1420 mm, a sendzimir mill having work rolls with an outer diameter of 70 mm, and a combination of both mills.

Tables 3 to 5 show diameters of rolls, cross angle (α) of rolls, surface roughnesses Ra of rolls and rolling reduction rates of mills which were used in the preliminary rolling. The surface roughness of the work rolls under all condition in an average roughness Ra is within the scope of the claimed invention.

The cold rolling in the regular rolling was carried out in an all parallel rolling manner and the rolling reduction rate was set to be 82% in total together with the rolling reduction rate in the preliminary rolling (that is, a cold rolled strip as a final product was set to be 0.8 mm in thickness). Rolling in the sendzimir mill was carried out at 8 passes. In the case of the combination of the tandem mill array and the sendzimir mill, the strip was rolled to 1.0 mm in thickness by the tandem mill array and then to 0.8 mm in thickness at one pass by the sendzimir mill.

A lubrication oil used in the preliminary rolling was an emulsion oil of synthetic esters.

Tables 3 to 5 also show surface glosses of produced cold rolled stainless steel strip. These glosses were determined by a visual inspection and evaluated in five ranks from A to E in order of gloss.

In order to verify the effect of the method in accordance with the present invention, Tables 3 to 5 also show results of examples for comparison in which after a pickled hot rolled steel strip was initially cold rolled in the parallel rolling manner at a rolling reduction rate of 5%, that is, the steel strip was cold rolled at a rolling reduction rate of 5% without preliminary cold rolling by the cross rolling manner, the cold rolling in the usual parallel rolling manner was carried out, and in which the pickled hot rolled steel strip was cold rolled in the usual parallel rolling manner without preliminary cold rolling.

Table 3 shows a case in which the regular rolling after the preliminary rolling was carried out in the usual parallel rolling manner in the tandem mill array, Table 4 a case in which it was carried out in the reversible rolling manner in the sendzimir mill, and Table 5 a case in which a regular rolling was carried out in the tandem mill array to roll a material to 10 mm in thickness and then the material was rolled to 0.8 mm in thickness in the parallel rolling manner in the sendzimir mill.

Test Nos. 1 to 8 in Table 3 are examples of the present invention. Although the surface gloss was rank B in the examples since the regular rolling was carried out only in the parallel rolling manner in the tandem mill array, the examples show the great effectiveness of the method of the present invention in comparison with examples for comparison (Test Nos. 9 and 10) in which the preliminary rolling was not carried out or carried out in the parallel rolling manner.

Test Nos. 11 to 18 in Table 4 are examples of the present invention. The regular rolling in the sendzimir mill can improve the surface gloss. This clarifies an effect of the method of the present invention in comparison with examples for comparison Nos. 19 and 20.

Table 5 shows examples of a combination of tandem rolling suitable for mass production and rolling by the sendzimir mill suitable for improvement of the surface gloss. In Test Nos 29 and 80 of examples for comparison the effect of tandem rolling was not canceled and the surface gloss was low. Examples of the present invention (Test No. 21 to 28) are all rank A in gloss.

It will be apparent from Tables 3 to 5 that the cold rolling of the method of the present invention can improve the surface gloss of a cold rolled steel strip. Also, it will be apparent that the surface gloss can be improved by one rank in rolling by the sendzimir mill having work rolls with a small diameter than in rolling by the tandem mill array having work rolls with a large diameter. However, according to the method of the present invention, even cold rolling only by the tandem mill array can greatly improve surface gloss in comparison with a conventional rolling method and can obtain a surface gloss while is sufficiently high that only conventional rolling by the sendzimir mill could obtain the same result. This means that a cold rolled stainless steel strip can be efficiently produced by the tandem mill array.

TABLE 3

| | | Preliminary Rolling | | | | Visual Decision | |
|---|---|---|---|---|---|---|---|
| | | Work Roll | | | | of Surface | |
| Section | Test No. | Outer Diameter (mm) | Cross Angle (°) | Average Roughness Ra (μm) | Rolling Reduction Rate (%) | Gloss of Cold Rolled Steel Plate | Rolling Manner |
| Examples of Subject Invention | 1 | 350 | 0.2 | 0.5 | 25 | B | Rolling by Tandem Mills |
| | 2 | 350 | 0.8 | 0.5 | 25 | B | |
| | 3 | 350 | 1.5 | 0.5 | 25 | B | |
| | 4 | 350 | 0.8 | 0.1 | 25 | B | |
| | 5 | 350 | 0.8 | 2.0 | 25 | B | |
| | 6 | 350 | 0.8 | 0.5 | 25 | B | |
| | 7 | 350 | 0.8 | 0.5 | 30 | B | |
| | 8 | 350 | 0.8 | 0.5 | 5 | B | |
| Examples for Comparison | 9 | 350 | 0 | 0.5 | 5 | D | |
| | 10 | Without Preliminary Rolling | | | | E | |

TABLE 4

| Section | Test No. | Preliminary Rolling: Work Roll: Outer Diameter (mm) | Cross Angle (°) | Average Roughness Ra (μm) | Rolling Reduction Rate (%) | Visual Decision of Surface: Gloss of Cold Rolled Steel Plate | Rolling Manner |
|---|---|---|---|---|---|---|---|
| Examples of Subject Invention | 11 | 250 | 0.2 | 0.3 | 20 | A | Rolling by Sendzimir Mill |
| | 12 | 250 | 0.5 | 0.3 | 20 | A | |
| | 13 | 250 | 1.0 | 0.3 | 20 | A | |
| | 14 | 250 | 0.5 | 0.1 | 20 | A | |
| | 15 | 250 | 0.5 | 1.0 | 20 | A | |
| | 16 | 80 | 0.5 | 0.3 | 20 | A | |
| | 17 | 250 | 0.5 | 0.3 | 25 | A | |
| | 18 | 250 | 0.5 | 0.3 | 5 | A | |
| Examples for Comparison | 19 | 250 | 0 | 0.3 | 5 | B | |
| | 20 | Without Preliminary Rolling | | | | B | |

TABLE 5

| Section | Test No. | Preliminary Rolling: Work Roll: Outer Diameter (mm) | Cross Angle (°) | Average Roughness Ra (μm) | Rolling Reduction Rate (%) | Visual Decision of Surface: Gloss of Cold Rolled Steel Plate | Rolling Manner |
|---|---|---|---|---|---|---|---|
| Examples of Subject Invention | 21 | 450 | 0.2 | 0.4 | 15 | A | Rolling by Tandem Mills + Rolling by Sendzimir Mill |
| | 22 | 450 | 1.5 | 0.4 | 15 | A | |
| | 23 | 450 | 2.0 | 0.4 | 15 | A | |
| | 24 | 450 | 1.5 | 0.1 | 15 | A | |
| | 25 | 450 | 1.5 | 1.5 | 15 | A | |
| | 26 | 250 | 1.5 | 0.4 | 15 | A | |
| | 27 | 450 | 1.5 | 0.4 | 25 | A | |
| | 28 | 450 | 1.5 | 0.4 | 5 | A | |
| Examples for Comparison | 29 | 450 | 0 | 0.4 | 5 | C | |
| | 30 | Without Preliminary Rolling | | | | D | |

[EXAMPLE 3]

Example 3 shows cold rolling when joining cross and parallel rollings in regular rolling after preliminary rolling. The material to be rolled is a hot rolled steel strip (4.5 mm in thickness) of the same annealed and pickled ferritic stainless steel (JIS SUS 430) as that of Example 1. Preliminary rolling used each of the mills which were used in Example 1 and was carried out under conditions ① to ⑨ shown in Table 6. Condition ⑨ in Table 6 is an example not including preliminary rolling in these mills.

Regular rolling used the same tandem mill array having five stands as that of Example 2. Cold rolling was carried out at at least one stand of the 1st and 2nd or 1st, 2nd and 3rd stands in the cross rolling manner, and then the strip was finally cold rolled to 0.8 mm in thickness at successive stands in the usual parallel rolling manner. The lubrication oil used in the preliminary and regular rollings was an emulsion oil of synthetic esters.

Tables 7 and 8 show conditions of preliminary rolling (No. ① to ⑨ in Table 6) and conditions of regular cold rolling by the cross rolling manner. Tables 7 and 8 also show surface glosses of a cold rolled stainless steel strip finished by the parallel rolling manner after the cross rolling. A standard of evaluation of gloss was the same as that of Example 2.

Test Nos. 1 to 13 in Tables 7 and 8 are all examples of the present invention.

Test Nos. 11 to 13 are cases in which the preliminary rolling in the cross rolling manner was directly carried out at the first stand, the first and second stands or the first to third stands of the tandem mill array without rolling in the preliminary rolling mill, and then the cold rolling in the parallel rolling manner was carried out in the same tandem mill array. That is, the initial rolling in the tandem rolling is the preliminary rolling in Test Nos. 11 to 13.

It will be apparent from comparison between the surface glosses in Table 3 and Tables 7 and 8 that the gloss of the cold rolled steel plate can be greatly improved by preliminarily cold rolling by cross rolling, regular cold rolling in the cross rolling manner, and then cold rolling in the usual parallel rolling manner. Test No. 11 in Table 8 is substantially the same as Example 1 since the cross rolling was carried out only once. This does not corresponds to the invention of claim 3 and is inferior to gloss. However, it will be apparent that the same effect can be obtained by directly carrying out cold rolling corresponding to the preliminary rolling in the regular mill without the need for preliminary rolling by a particular mill.

Although the above examples were directed to ferritic stainless steel, the cold rolling of the present invention could produce a cold rolled steel strip having the same surface gloss from a hot rolled stainless steel strip of JIS SUS 304 steel strip as an example of austenitic stainless steel.

TABLE 6

| Condition No. | Preliminary Rolling Condition: Work Roll: Outer Diameter (mm) | Inter-section Angle (°) | Average Roughness Ra (μm) | Rolling Reduction Rate (%) |
|---|---|---|---|---|
| ① | 350 | 0.2 | 0.5 | 25 |
| ② | 350 | 0.8 | 0.5 | 25 |
| ③ | 350 | 1.5 | 0.1 | 25 |
| ④ | 450 | 0.8 | 2.0 | 25 |
| ⑤ | 350 | 0.8 | 0.5 | 25 |
| ⑥ | 120 | 0.8 | 0.5 | 25 |
| ⑦ | 350 | 0.8 | 0.5 | 30 |
| ⑧ | 350 | 0.8 | 0.5 | 5 |
| ⑨ | Without Preliminary Rolling | | | |

medially annealed after being cold rolled. The starting materials were prepared by cold rolling a hot rolled stainless steel strip (4.5 mm in thickness) of austenitic stainless steel (JIS SUS 304) to 2.0 mm in thickness and then bright-annealing (atmosphere free of oxidation) the strip, and by cold rolling a hot rolled steel strip (4.5 mm in thickness) of ferritic stainless steel (JIS SUS 430) to 1.5 mm in thickness and then annealing and pickling the strip.

Preliminary mills were a four-high mill having work rolls of 450 mm in diameter and a six-high mill having work rolls of 120 mm in diameter.

First, preliminary rolling in the cross rolling manner was carried out under various conditions as shown in Table 9 by these preliminary rolling mills. Second, cold rolling (regular rolling) was carried out by a tandem mill array having five stands with work rolls of 450 mm in diameter and backup rolls of 1420 mm in diameter. Rolling conditions are shown in Table 10. The cold rolling during regular rolling was

TABLE 7

| Section | Test No. | Preliminary Rolling Condition No. | Cross Rolling Condition in Tandem Mill Array: Applied Stand | Work Roll: Outer Diameter (mm) | Cross Angle (°) | Average Roughness Ra (μm) | Rolling Reduction Rate (%) | Visual Decision of Surface: Gloss of Cold Rolled Steel Plate |
|---|---|---|---|---|---|---|---|---|
| Examples of Subject Invention | 1 | ① | #1 | 450 | 0.8 | 0.5 | 30 | A |
| | | | #2 | 450 | 0.7 | 0.3 | 30 | |
| | 2 | ② | #1 | 450 | 0.8 | 0.5 | 30 | A |
| | | | #2 | 450 | 0.7 | 0.3 | 30 | |
| | 3 | ③ | #1 | 450 | 0.8 | 0.5 | 30 | A |
| | | | #2 | 450 | 0.7 | 0.3 | 30 | |
| | 4 | ④ | #1 | 450 | 0.8 | 0.5 | 30 | A |
| | | | #2 | 450 | 0.7 | 0.3 | 30 | |
| | 5 | ⑤ | #1 | 450 | 0.8 | 0.5 | 30 | A |
| | | | #2 | 450 | 0.7 | 0.3 | 30 | |
| | 6 | ⑥ | #1 | 450 | 0.8 | 0.5 | 30 | A |
| | | | #2 | 450 | 0.7 | 0.3 | 30 | |
| | 7 | ⑦ | #1 | 450 | 0.8 | 0.5 | 30 | A |
| | | | #2 | 450 | 0.7 | 0.3 | 30 | |
| | 8 | ⑧ | #1 | 450 | 0.8 | 0.5 | 30 | A |
| | | | #2 | 450 | 0.7 | 0.3 | 30 | |

TABLE 8

| Section | Test No. | Preliminary Rolling Condition No. | Cross Rolling Condition in Tandem Mill Array: Applied Stand | Work Roll: Outer Diameter (mm) | Cross Angle (°) | Average Roughness Ra (μm) | Rolling Reduction Rate (%) | Visual Decision of Surface: Gloss of Cold Rolled Steel Plate |
|---|---|---|---|---|---|---|---|---|
| Examples of Subject Invention | 9 | ② | #1 | 450 | 0.8 | 0.3 | 30 | A |
| | 10 | ② | #1 | 450 | 0.8 | 0.5 | 30 | A |
| | | | #2 | 450 | 0.7 | 0.3 | 30 | |
| | | | #3 | 450 | 0.6 | 0.3 | 30 | |
| | 11 | ⑨ | #1 | 450 | 1.0 | 0.4 | 25 | B |
| | 12 | ⑨ | #1 | 450 | 0.8 | 0.4 | 20 | A |
| | | | #2 | 450 | 0.8 | 0.3 | 35 | |
| | 13 | ⑨ | #1 | 450 | 0.8 | 0.4 | 20 | A |
| | | | #2 | 450 | 0.8 | 0.3 | 30 | |
| | | | #3 | 450 | 0.6 | 0.3 | 35 | |

[EXAMPLE 4]

Equipment having the line construction shown in FIG. 1 was used for the following cold rolling of a material intercarried out in the manner of both all parallel rolling and of cross rolling at upper stream stands. The rolling reduction rate was 75% in total by adding the rolling reduction rate in preliminary rolling. The strips were finished to 0.8 mm thickness in the case of the austenitic stainless steel and to 0.45 mm in thickness in the case of the ferritic stainless steel.

A lubricant oil used in the preliminary rolling and finishing rolling was the same emulsion oil of synthetic esters as those of Examples 2 and 8. Table 10 shows also the surface glosses of produced cold-rolled steel strip. The roughness of the work roll is a most preferable mode. The evaluation was effected by five ranks A to E in the same manner as Examples 1 and 2.

TABLE 9

Figure 9:
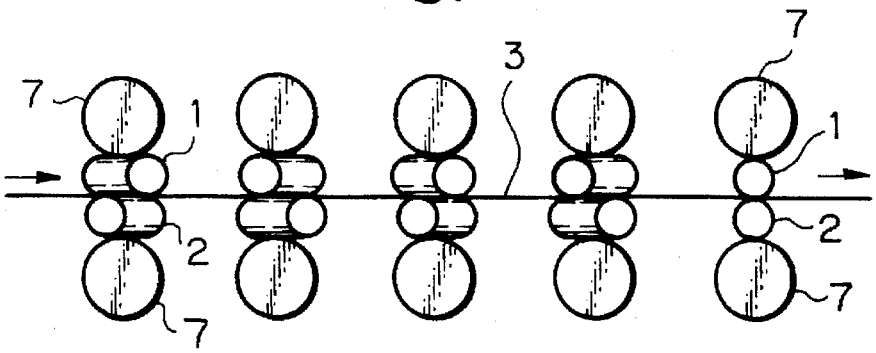
FIG. 9 is a schematic side view of a tandem mill array according to an embodiment of the present invention.
Figure 10:
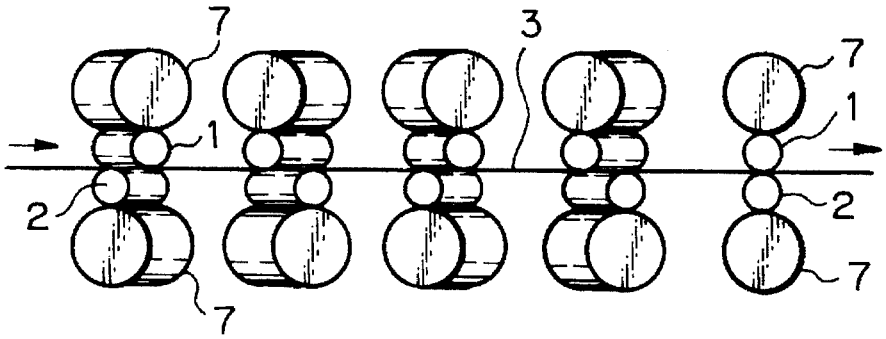
FIG. 10 is a schematic side view of a tandem mill array according to another embodiment of the present invention.

| | Preliminary Rolling Condition | | | |
|---|---|---|---|---|
| | Work Roll | | | |
| Condition No. | Outer Diameter (mm) | Cross Angle (°) | Average Roughness Ra (μm) | Rolling Reduction Rate (%) |
| ① | 450 | 0.8 | 0.5 | 20 |
| ② | 450 | 0.8 | 0.5 | 25 |
| ③ | 120 | 0.8 | 0.5 | 30 |
| ④ | Without Preliminary Rolling | | | |

direction perpendicular to the feeding direction of the strip 3 at the 1st to 4th stands having cross work rolls 1 and 2 shown in FIGS. 9 and 10. The cross angle of the rolls 1 and 2 in each mill stand is set in accordance with a given design value.

The cross angle α is an angle between a rolling speed (VS) direction (direction X) of the strip 3 which is cold rolled by the mill stand having crossed work rolls 1 and 2 and a rotary speed (VR) direction (direction Y) of the work rolls 1 and 2. Since the speed VS is substantially equal to the rotary speed VR of the work roll near the place where the strip 3 is outgoing from the work rolls, sliding components of force in the strip width direction are generated between the strip 3 and the work rolls 1 and 2 and surface layers in the strip 3 are subject to shearing deformation in the plate width direction, thereby improving the surface gloss of the strip 3.

Figure 11:
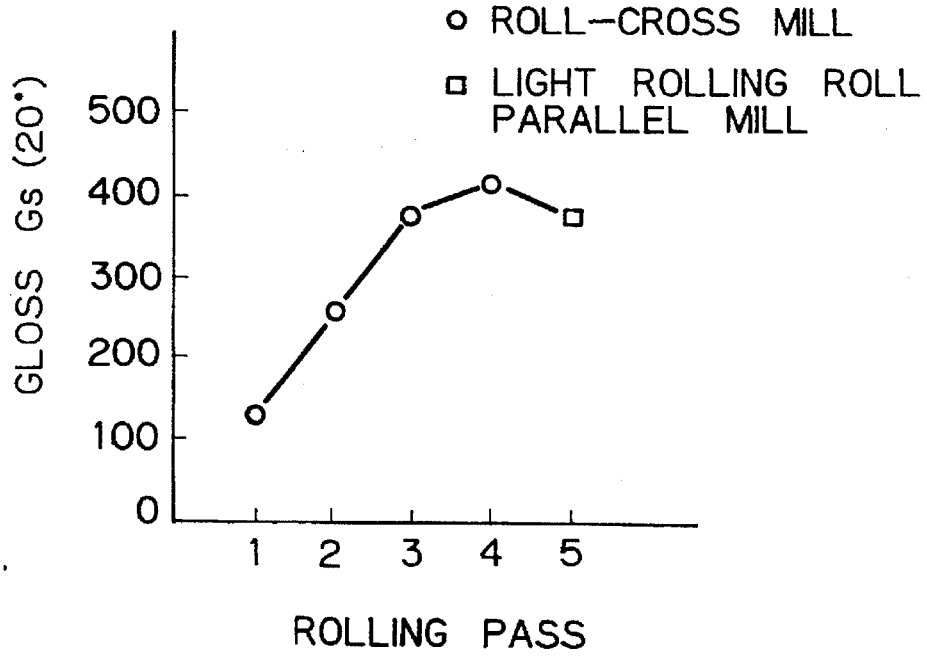
FIG. 11 is a graph showing gloss rate in test rolling by the mill arrays shown in FIGS. 9 and 10.

FIG. 11 is a graph showing the glosses measured by rolling tests in the mill array shown in FIGS. 9 and 10. In FIG. 11 the axis of abscissa indicates rolling passes and the axis of ordinate indicates the glosses. Marks ○ and □ in the drawing indicate a cross mill and a parallel mill with light reduction, respectively. A diameter of work rolls in the test

TABLE 10

| | | | | Cross Rolling Condition in Tandem Mill Array | | | | | Visual Decision of Sufface |
|---|---|---|---|---|---|---|---|---|---|
| | | | Preliminary | | Work Roll | | | | Gloss |
| Section | Quality of Material | Test No. | Rolling Condition No. | Applied Stand | Outer Diameter (mm) | Cross Angle (°) | Average Roughness (Ra μm) | Rolling Reduction Rate (%) | of Cold Rolled Plate |
| Examples of Subject Invention | SUS304 | 1 | ① | | All Parallel Rolling | | | | B |
| | | 2 | ② | #1 | 450 | 0.7 | 0.2 | 25 | A |
| | | | | #2 | 450 | 0.6 | 0.15 | 25 | |
| | SUS430 | 3 | ② | | All Parallel Rolling | | | | B |
| | | 4 | ③ | #1 | 450 | 0.7 | 0.3 | 30 | A |
| | | | | #2 | 450 | 0.6 | 0.2 | 30 | |
| Example for Comparison | SUS430 | 5 | ④ | | All Parallel Rolling | | | | E |

[EXAMPLE 5]

FIGS. 9 and 10 show tandem mill arrays embodying the cold rolling method of the present invention.

FIG. 9 is a schematic side view of a first embodiment of the tandem mill array which comprises five stands having a pair of upper and lower work rolls 1 and 2 and a pair of upper and lower backup rolls 7 and arranged in the rolling line direction. A cross mill is arranged in at least one stand of four stands exclusive of the final (right end) stand, in the present embodiment at all of the four stands and parallel mill with light reduction is provided at the final (right end) stand. In the cross mill, the upper and lower work rolls are crossed at axes in a plane parallel to the surface of a metal strip 3 (hereinafter referred to as "strip"). The strip 3 is fed through the stand of each mill in the direction of the arrow.

FIG. 10 shows a second embodiment having the same stand arrangement as that of FIG. 9. The upper and lower work rolls 1 and 2 and the upper and lower backup rolls 7 are crossed together.

As shown in FIG. 3(*a*) described above, shearing deformations in the width direction of the strip 3 are caused in opposite directions at cross angle α with respect to the mill was 260 mm, the surface roughness of the work rolls was 1 μm Rmax, a test material was usual steel of 2.3 mm in thickness, and a rolling speed was 5 m/min.

Table 11 shows a pass schedule of the above rolling test. The cross angles α in the 1st to 5th mill stands were 1.5, 1.5, 1.1, 1.0, and 0 degrees and the rolling reduction rates in the mill stands were 30%, 30%, 30%, 25%, and 3%. The reduction rate at the last stand was 3%.

TABLE 11

| | | Pass | | | | | |
|---|---|---|---|---|---|---|---|
| Item | Dimension | 1 | 2 | 3 | 4 | 5 | |
| Thickness | mm | 2.3 | 1.61 | 1.13 | 0.79 | 0.59 | 0.57 |
| Rolling Reduction Rate | % | — | 30 | 30 | 30 | 25 | 3 |

TABLE 11-continued

| Item | Dimension | Pass 1 | 2 | 3 | 4 | 5 |
|---|---|---|---|---|---|---|
| Tension | kgf/mm$^2$ | 1 | 10 | 14 | 21 | 24 | 2.5 |
| Cross Angle | degree (α) | 1.5 | 1.5 | 1.1 | 1.0 | 0 |

As shown in FIG. 11, the work roll rolling at the 1st to 4th mill stands imparted to the strip 3 a high gloss the parallel rolling at the light reduction rate at the final stand decreased a reduction rate of the gloss GS. The parallel rolling at the light reduction rate could correct the plate torsion in the strip caused by the cross rolling at the upper stream stands.

Figure 12:
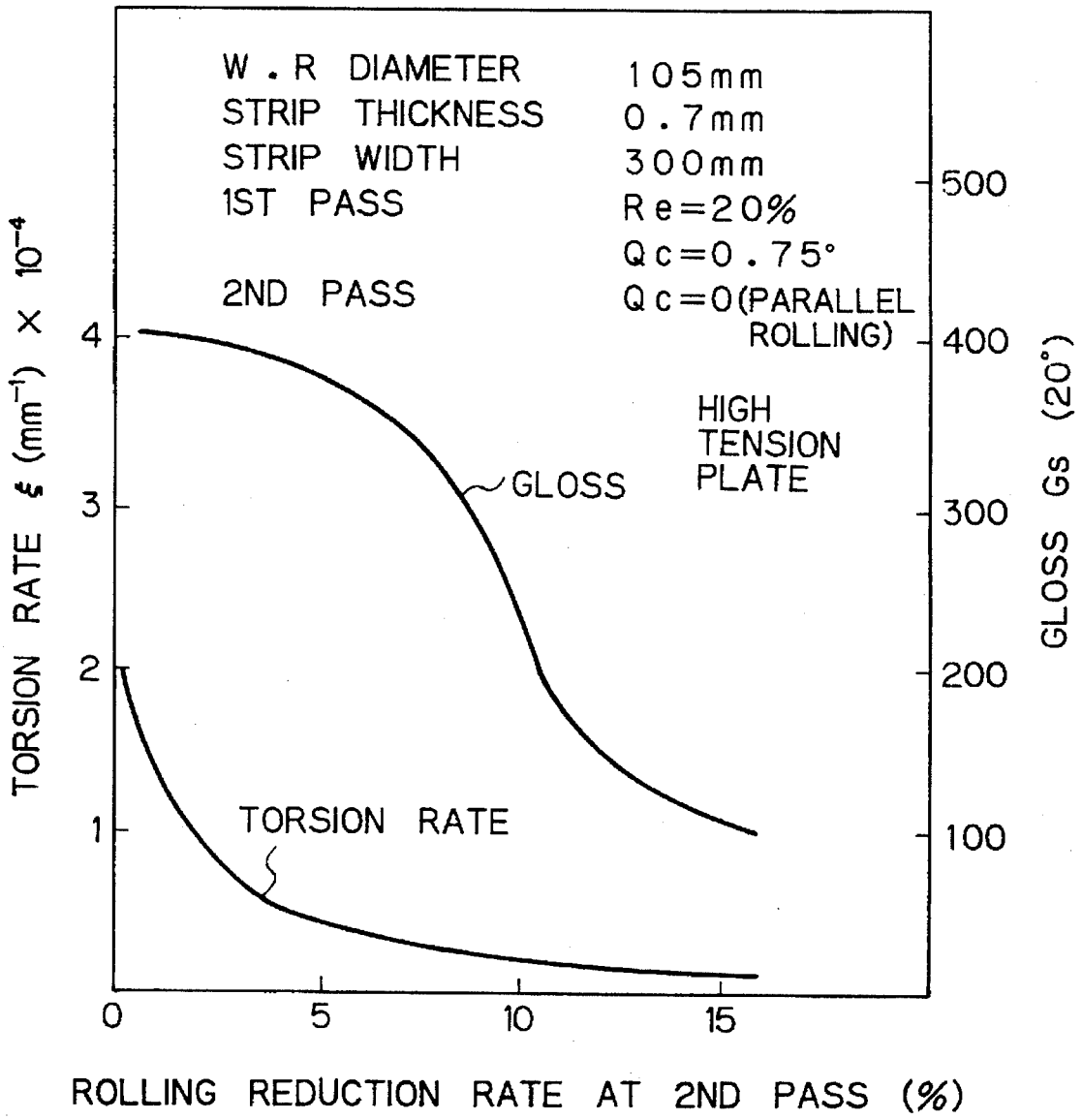
FIG. 12 is a graph showing gloss, torsion rates, and rolling reduction rates in test rolling by work cross rolling and parallel rolling at the 4th and 5th stands.

FIG. 12 is a graph showing a relationship between the glosses GS and the torsion rates ξ after 4th stand with work roll of 105 mm in diameter, the roll cross angle of 0.75° and the rolling reduction rate of 20% and passed through the 5th stand set in the rolling reduction rate of 0° and the rolling reduction rate at the second pass or the 5th stand. In FIG. 12, the axis of ordinate indicates the torsion rate ξ and the gloss and the axis of abscissa indicates the rolling reduction rate (%). FIG. 5 illustrates the torsion rate ξ. It will be apparent from FIG. 12 that the parallel rolling at the rolling reduction rates of 3 to 8% at the third pass or the final stand reduces the torsion rate ξ and suppresses reduction of the gloss GS.

It will be understood from the above test results that the work parallel rolling at the light rolling reduction rate at the final stand after the work roll cross; rolling at the upper stream stands exclusive of at least the final stand in the tandem mill array does not lose a high gloss of the strip obtained by the cross rolling and can properly correct strip torsion in the strip caused by work roll cross rolling.

Although the embodiments of the present invention are described above, the present invention is not limited to the apparatus in the above embodiments and various alternations in design can be carried out within the technical scope of the present invention.

According to the method of the present invention, it is possible to easily prevent torsion caused in a rolled material during the cross rolling. Consequently, it is possible to efficiently produce a rolled metal strip with a high quality.

Further, the cold rolling method of the present invention can produce a rolled metal strip having excellent surface gloss. In particular, heretofore in a cold rolling method employing large work rolls of a tandem mill array and the like could not obtain the same level of gloss as that obtained by a cold rolling method employing small work rolls of a sendzimir type and the like. However, it is possible according to the cold rolling method of the present invention to greatly improve the surface gloss of a rolled metal strip even in continuous rolling in a tandem mill array.

According to the tandem mill array embodying the method of the present invention, it is possible to correct torsion in a rolled material and to improve the quality of products.

It will be apparent From the above test results that the work parallel rolling at the light rolling reduction at the final stand of the work parallel mill, after the cross decrease in the high gloss of the strip obtained by the cross rolling and can properly correct torsion in a strip caused by cross rolling.

I claim:

1. A method for cold rolling a stainless steel strip comprising first performing cross rolling processes on the stainless steel strip, subsequently performing parallel rolling processes on the stainless steel strip upon cold rolling the strip, setting a surface roughness of work rolls in at least the cross rolling processes to be 0.1 to 2 μm in an average roughness Ra, and setting a total rolling reduction rate in the parallel rolling processes to be 3% to 8%.

2. A method according to claim 1, wherein said stainless steel strip is prepared for preliminary cold rolling by cross rolling, at a rolling reduction rate of over 5%, a pickled hot rolled strip.

3. A method according to claim 1, wherein said stainless steel strip is prepared for preliminary rolling by cross rolling, at a rolling reduction rate of over 5%, a hot rolled strip which is pickled after annealing.

4. A method according to claim 1, wherein said stainless steel strip is prepared for preliminary rolling by cross rolling, at a rolling reduction rate of over 5%, a cold rolled strip which is either intermediately annealed after cold rolling or intermediately annealed and intermediately pickled.

5. A method according to any one of claims 2, 3 and 4, wherein a cross angle α of the work rolls in said preliminary rolling is over 0.2 degs.

6. A method according to claim 1, wherein said cross rolling processes comprise a rolling stage by a plurality of cross rolls, with crossing directions of upper and lower work rolls in the rolling stage being alternately reversed.

7. A method according to claim 6, wherein said stainless steel strip is prepared for preliminary cold rolling by cross rolling, at a rolling reduction rate of over 5%, a pickled hot rolled strip.

8. A method according to claim 6, wherein said stainless steel strip is prepared for preliminary rolling by cross rolling, at a rolling reduction rate of over 5%, a hot rolled strip which is pickled after annealing.

9. A method according to claim 6, wherein said stainless steel strip is prepared for preliminary rolling by cross rolling, at a rolling reduction rate of over 5%, a cold rolled strip which is either intermediately annealed after cold rolling or intermediately annealed and intermediately pickled.

10. A method according to any one of claims 7, 8 and 9, wherein a cross angle α of the work rolls in said preliminary rolling is greater than 0.2 degs.

* * * * *